US007241128B2

(12) United States Patent
Blok

(10) Patent No.: US 7,241,128 B2
(45) Date of Patent: Jul. 10, 2007

(54) ROLLER ADJUSTMENT APPARATUS FOR AN EXTRUSION MILL

(75) Inventor: Jesper Blok, Bramming (DK)

(73) Assignee: Sprout-Matador A/S, Esbjert O (DK)

( * ) Notice: Subject to any disclaimer, the term of this patent is extended or adjusted under 35 U.S.C. 154(b) by 0 days.

(21) Appl. No.: 10/546,028

(22) PCT Filed: Feb. 21, 2003

(86) PCT No.: PCT/DK03/00115

§ 371 (c)(1),
(2), (4) Date: Mar. 30, 2006

(87) PCT Pub. No.: WO2004/073963

PCT Pub. Date: Sep. 2, 2004

(65) Prior Publication Data

US 2006/0193936 A1 Aug. 31, 2006

(51) Int. Cl.
*B30B 11/20* (2006.01)

(52) U.S. Cl. ..... 425/331; 425/193

(58) Field of Classification Search ..... 425/331, 425/193

See application file for complete search history.

(56) References Cited

U.S. PATENT DOCUMENTS 2,157,528 A 5/1939 Crabtree
3,538,546 A 11/1970 Gilman
3,559,238 A 2/1971 Gilman
4,498,856 A 2/1985 Botha et al.
4,861,529 A 8/1989 Groebli et al.
5,248,469 A 9/1993 Wilhelm

FOREIGN PATENT DOCUMENTS

FR 2 591 438 6/1987

*Primary Examiner*—Robert Davis
*Assistant Examiner*—Marissa W. Chaet
(74) *Attorney, Agent, or Firm*—Stites & Harbison PLLC; Douglas E. Jackson

(57) ABSTRACT

In a roller adjustment apparatus for an extrusion mill, comprising a cylindrical die (2) with radially extending extrusion channels and a number of rollers (1) within the die, rotatable about their axes and co-operating with the die to press material to be treated through the extrusion channels in the die wall, the adjustment apparatus comprises eccentrically journalled bearing shafts (3) for mounting the rollers (1), said eccentrically journalling of the shafts (3) providing a radial adjustment of the position of the rollers (1) relative to the die (2), the rotation of the eccentrically journalled shafts (3) is provided by means of extension arms (6) fixedly mounted on the ends of the eccentrically journalled shafts (3), and said extension arms (6) being connected to an axially movable connection element (8) by means of articulated connected linkage rods (7), and said connection element (8) being connected to a rod (9) provided with its axis in the axis of the die (2) and extending to a position outside the material flow of the extrusion mill to move the connection element (8) in the direction of the axis of the die (2), said axial movement being provided manually or by means of a suitable actuator connected to the rod (9). In this way, only simple mechanical components, such as linkage rods (7) and connection elements (8) are positioned close to the rollers and these components are moved by manual adjustment or by means of suitable actuators positioned outside the aggressive environment close to the rollers of the extrusion mill.

8 Claims, 3 Drawing Sheets

ROLLER ADJUSTMENT APPARATUS FOR AN EXTRUSION MILL

TECHNICAL FIELD

The present invention relates to a roller adjustment apparatus for an extrusion mill of the kind set forth in the preamble of claim 1.

BACKGROUND ART

In extrusion mills it is known to provide some kind of adjustment of the distance between the rollers and the die and to provide a possibility of performing the adjustment during operation, in order to optimise the pelletising process. The known apparatus for performing such adjustments provides the adjustment by using hydraulic cylinders directly connected to the roller shafts, as shown in U.S. Pat. No. 4,861,529 or provides the adjustment via a rotational shaft positioned in the axis of the mill and connected to the roller shafts via a cam plate or gear mechanisms, as shown in EP-238,147 or EP-594,278.

DISCLOSURE OF THE INVENTION

It is the object of the present invention to provide a roller adjustment apparatus of the kind referred to above, with which it is possible to avoid positioning of sensitive mechanical components close to the rollers, where an aggressive environment is present, and this object is achieved with a roller adjustment apparatus of said kind, which according to the present invention also comprises the features set forth in the characterising clause of claim 1. With this arrangement, only simple mechanical components such as linkage rods and connection elements are positioned close to the rollers and these components are moved by manual adjustment or by means of suitable actuator means positioned outside the aggressive environment close to the rollers of the extrusion mill. Preferred embodiments of the roller adjustment apparatus, the advantages of which will be evident from the following detailed description, are revealed in the sub-ordinate claims.

BRIEF DESCRIPTION OF THE DRAWINGS

In the following detailed part of the present description, the invention will be explained in more details with reference to the exemplary embodiment of a roller adjustment apparatus in accordance with the invention shown in the drawings, in which.

DESCRIPTION OF THE PREFERRED EMBODIMENT

Figure 1:
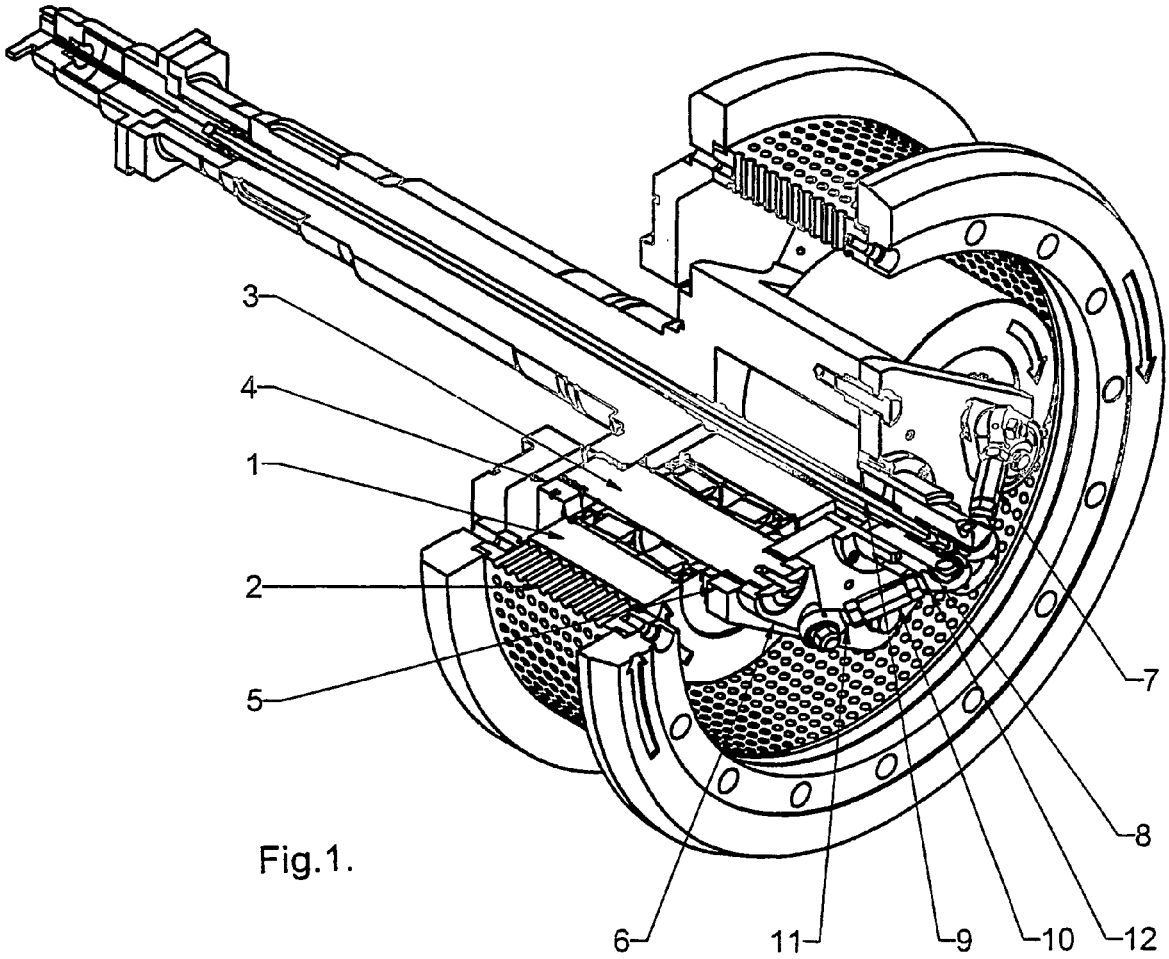
FIG. 1 shows a partly cut-up perspective view of the roller adjustment apparatus in an extrusion mill comprising two rollers.
Figure 2:
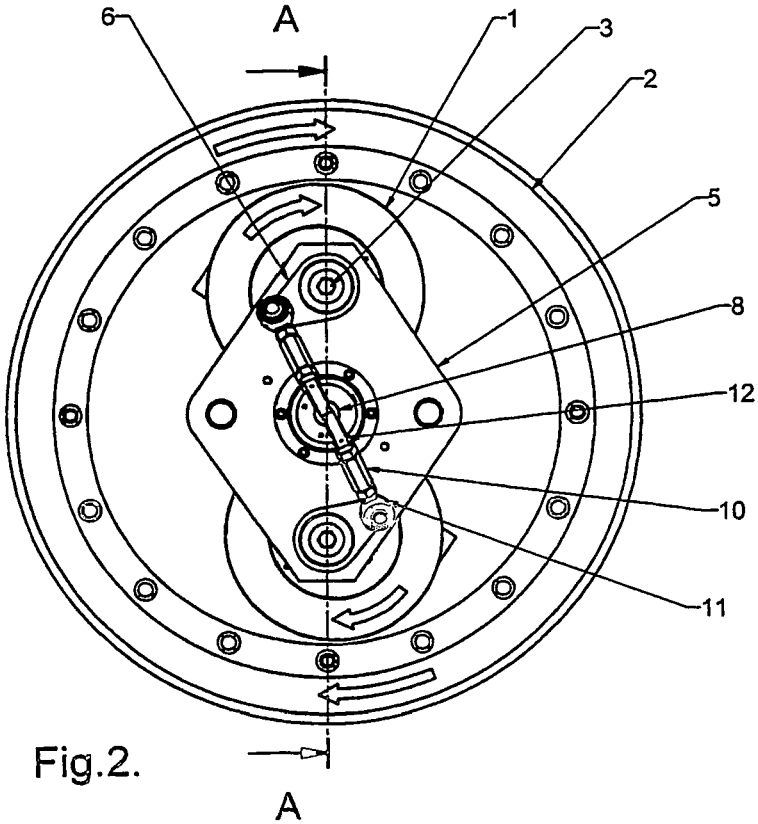
FIG. 2 shows the apparatus of FIG. 1 seen from one end.

The apparatus shown in FIG. 1 comprises the major part of an extrusion mill for pelletising foodstuff of different kinds. The extrusion mill comprises a cylindrical die (2) with radially extending extrusion channels and a number of rollers (1), in FIGS. 1-3 the number of rollers is two. The rollers (1) are mounted for rotation about their axes and to co-operate with the cylindrical die (2) to press material to be treated through the extrusion channels in the die wall. The means for driving (not shown) provides a rotation of the cylindrical die (2) and the axes of the rollers (1) relative to each other about the axis of the cylindrical die (2). The rollers (1) are mounted on bearing shafts (3), said bearing shafts (3) being eccentrically journalled in bores in a rear roller support flange (4) and a front roller support plate (5), said rear and front roller support flange and plate being mutually connected by means of connection elements positioned between the rollers (1). The eccentrical journalling of the shafts (3) provides the possibility of obtaining a radial adjustment of the positions of the rollers (1) relative to the cylindrical die (2) by rotation of the eccentrically journalled shafts (3). In order to provide the rotational adjustment of the eccentrically journalled shafts (3), extension arms (6) are fixedly mounted on the ends of the eccentrically journalled shafts (3), and said extension arms (6) are connected to an axially movable connection element (8) by means of articulated connected linkage rods (7) in the form of turnbuckles, said turnbuckles providing a possibility of performing a zero point adjustment of the position of the rollers (1) relative to the cylindrical dies (2). The connection element (8) is connected to a rod (9) provided with its axis in the axis of the cylindrical die (2) and extending to the outside of the extrusion mill, where it is connected to suitable actuator means.

The relative rotation of the rollers (1) and the cylindrical die (2) can be provided by keeping the bearing shafts (3) for the rollers (1) stationary and rotating the cylindrical die (2) or vice versa keeping the cylindrical die (2) stationary and rotating the bearing shafts for the rollers (1), in which case a rotational linkage will have to be provided between the actuator and the connection element (8), possibly at the actuator end of the rod (9).

Figure 3:
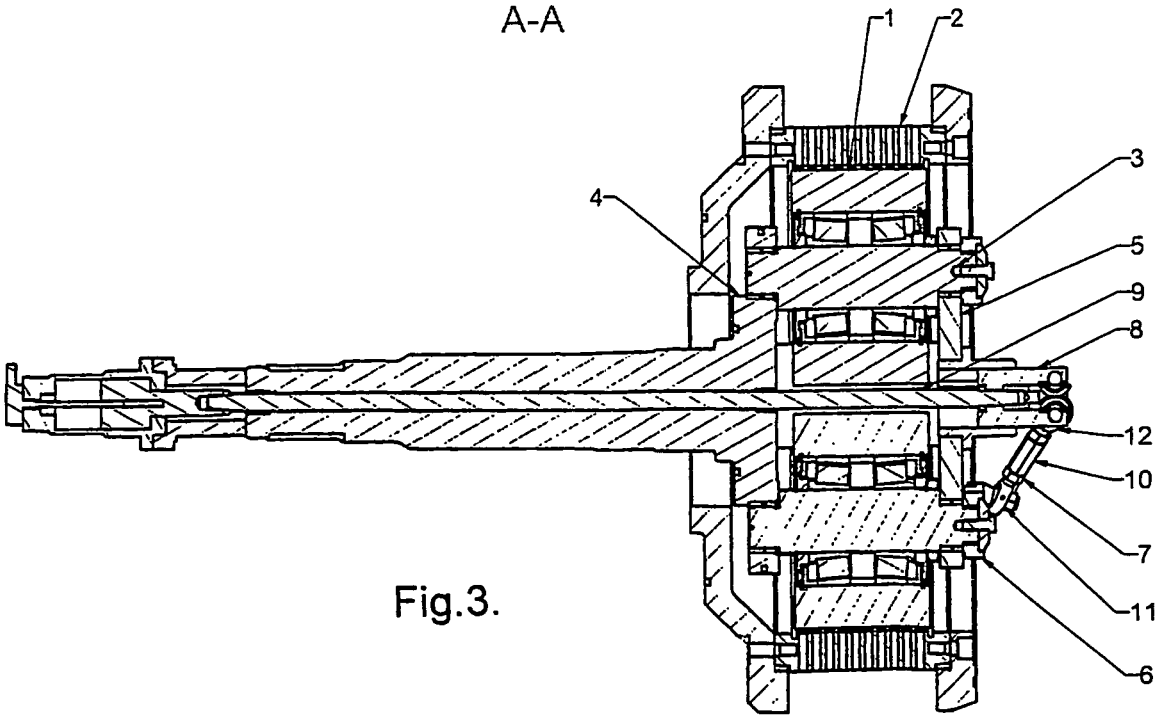
FIG. 3 shows the apparatus of FIGS. 1 and 2 in cross section along the line III-III in FIG. 2, and FIGS. 4 and 5 schematically show a corresponding apparatus in an extrusion mill comprising three rollers.
Figure 4:
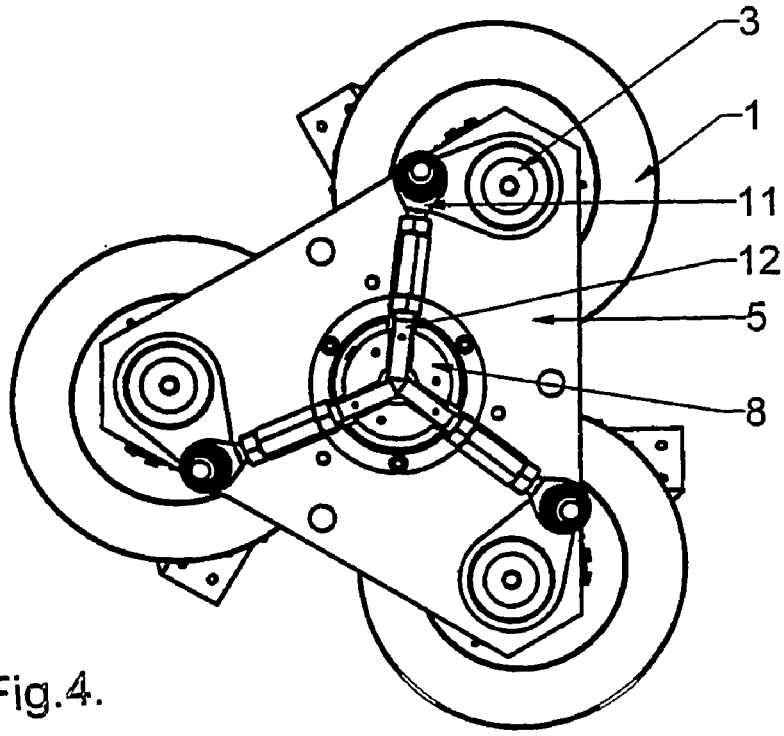
Figure 5:
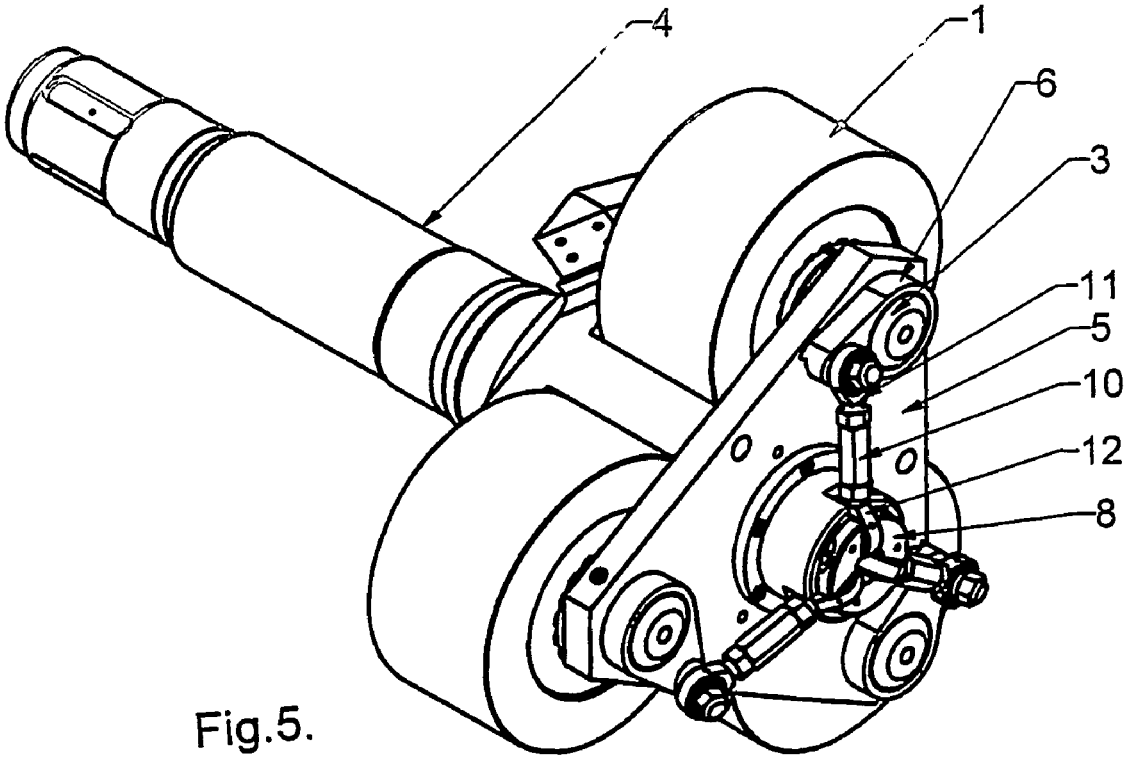

As can be seen from FIG. 3, the axial movement of the connection element (8) provides a rotational movement of the eccentrically journalled shafts (3), which results in a movement of the rollers (1) towards or away from the cylindrical die (2), whereby the distance between the rollers (1) and the die (2) can be adjusted in accordance with the desired function of the extrusion mill. The turnbuckles (7) provide a possibility of adjusting a zero point position of the rollers (1) and the adjusted position can be secured by means of suitable nuts mounted on the turnbuckles (7). The connection between the turnbuckles and the connection element and the extension arms, respectively, is provided in the form of a ball joint (11, 12) connected to the bolts of the turnbuckle (10), thus providing an articulated connection between the extension arms (6) and the connection element (8).

Preferably the mechanism is dimensioned and adjusted in such a way that the turnbuckles (7) are positioned perpendicular to the axis of the cylindrical die (2) when the rollers (1) are in a position as close as possible to the cylindrical die (2), yet without metallical contact between the rollers (1) and the cylindrical die (2). This provides a transmission between the actuator and the position of the rollers (1) with a maximum force when the roller (1) is close to the cylindrical die (2) and furthermore a fine adjustment possibility for the distance between the roller (1) and the cylindrical die (2) with high precision when the roller (1) is close to the cylindrical die (2).

This last feature can be further supported by having the eccentricity of the eccentrically journalled bearing shafts (3)

close to the top point in the situation where the rollers (1) are close to the cylindrical die (2).

Above, the invention has been described in connection with a preferred embodiment thereof, but several modifications can be envisaged without departing from the following claims, such deviations comprising the provision of another number of rollers (1), the preferred number of the rollers being two or three. Furthermore, the actuator connected to the rod (9) can be provided in the form of a hydraulic or pneumatic piston cylinder unit, a linear actuator of the lead screw type, or any other type of actuator suitable for the purpose. Manual adjustment of the position of the rod (9) could also be envisaged. Also the position of the actuator could be altered, e.g. to a position inside the shaft (4), in which situation the rod (9) may be the piston rod of a piston cylinder unit, or at the side opposite the shaft (4).

The invention claimed is:

1. Roller adjustment apparatus for an extrusion mill, in particular a pellet mill, comprising a cylindrical die with radially extending extrusion channels and a number of rollers within the die, rotatable about their axes and co-operating with the die to press material to be treated through the extrusion channels in the die wall, with driving means to rotate the die and the axes of the rollers relative to each other about the axis of the die, said adjustment apparatus comprising eccentrically journalled bearing shafts for mounting the rollers, said eccentrically journalling of the shafts providing a radial adjustment of the position of the rollers relative to the die by rotation of the eccentrically journalled shafts, characterized by the rotational adjustment of the eccentrically journalled shafts being provided by means of extension arms fixedly mounted on the ends of the eccentrically journalled shafts, said extension arms being connected to an axially movable connection element by means of articulated connected linkage rods, and said connection element being connected to a rod provided with its axis in the axis of the die and extending to a position outside the material flow of the extrusion mill to move the connection element in the direction of the axis of the die, said axial movement being provided manually or by means of a suitable actuator connected to the rod.

2. Roller adjustment apparatus in accordance with claim 1, characterized by the linkage rods being provided in the form of turnbuckles.

3. Roller adjustment apparatus in accordance with claim 1, characterized by the linkage rods being arranged to be positioned perpendicular to the axis of the die, when the rollers are adjusted to the position closest to the die.

4. Roller adjustment apparatus in accordance with claim 1, characterized by the actuator connected to the rod being provided in the form of a hydraulic cylinder-piston unit.

5. Roller adjustment apparatus in accordance with claim 1, characterized by the actuator connected to the rod being provided in the form of a linear actuator of the lead screw type.

6. Roller adjustment apparatus in accordance with claim 1, characterized by the actuator connected to the rod being positioned on that side of the extrusion mill, which is opposite the inlet for the material to be treated.

7. Roller adjustment apparatus in accordance with claim 1, characterized by the number of rollers inside the cylindrical die being between one and six.

8. Roller adjustment apparatus in accordance with claim 7, characterized by the number of rollers inside the cylindrical die being two or three.

* * * * *